US008607520B2

(12) United States Patent
Mencio

(10) Patent No.: US 8,607,520 B2
(45) Date of Patent: Dec. 17, 2013

(54) THERMALLY REFLECTIVE PANEL ASSEMBLY

(76) Inventor: Charles Arthur Mencio, San Antonio, TX (US)

( * ) Notice: Subject to any disclaimer, the term of this patent is extended or adjusted under 35 U.S.C. 154(b) by 0 days.

(21) Appl. No.: 13/356,725

(22) Filed: Jan. 24, 2012

(65) Prior Publication Data

US 2012/0186184 A1 Jul. 26, 2012

Related U.S. Application Data

(60) Provisional application No. 61/461,958, filed on Jan. 25, 2011.

(51) Int. Cl.
*E04C 2/34* (2006.01)

(52) U.S. Cl.
USPC ..... 52/481.1; 52/582.1; 52/783.1; 52/309.14; 52/580; 52/408; 52/459; 52/417; 428/68

(58) Field of Classification Search
USPC ..... 52/481.1, 302.1, 309.8, 309.13, 309.14, 52/144, 145, 745.11, 407.5, 309.9, 578, 52/591.4, 745.19, 268, 269, 582.1, 783.1, 52/580, 408, 409, 459, 417, 309.17, 52/396.04; 428/119, 180, 118, 68; 181/290, 291, 292, 293
See application file for complete search history.

(56) References Cited

U.S. PATENT DOCUMENTS

| | | | | | |
|---|---|---|---|---|---|
| 3,885,008 | A * | 5/1975 | Martin | 264/45.3 |
| 4,185,437 | A * | 1/1980 | Robinson | 52/601 |
| 4,471,591 | A * | 9/1984 | Jamison | 52/309.9 |
| 4,558,552 | A * | 12/1985 | Reitter, II | 52/745.19 |
| 4,702,046 | A * | 10/1987 | Haugen et al. | 52/144 |
| 4,803,108 | A * | 2/1989 | Leuchten et al. | 428/118 |
| 5,157,892 | A * | 10/1992 | Ryther | 52/793.11 |
| 5,433,050 | A * | 7/1995 | Wilson et al. | 52/302.1 |
| 5,487,930 | A * | 1/1996 | Lockshaw et al. | 428/53 |
| 6,114,003 | A * | 9/2000 | Gottfried | 428/73 |
| 6,857,241 | B1 * | 2/2005 | Pellicer | 52/583.1 |
| 6,901,713 | B2 * | 6/2005 | Axsom | 52/481.1 |
| 7,877,938 | B2 * | 2/2011 | Bennett et al. | 52/177 |
| 7,946,384 | B2 * | 5/2011 | Foster et al. | 181/290 |
| 8,046,969 | B2 * | 11/2011 | Dagher et al. | 52/588.1 |
| 2003/0192279 | A1 * | 10/2003 | Hughart | 52/481.1 |
| 2004/0048045 | A1 * | 3/2004 | Thomsen et al. | 428/180 |
| 2005/0188626 | A1 * | 9/2005 | Johnson | 52/144 |

* cited by examiner

*Primary Examiner* — Chi Q Nguyen

(57) ABSTRACT

A thermally reflective panel assembly for use in a structure, the roof panel assembly comprising an exterior panel having opposing outer and inner surfaces separated by exterior panel edge surfaces; an interior panel having opposing outer and inner surfaces separated by interior panel edge surfaces that are aligned with the exterior panel edge surfaces; an intermediate section fixed to the inner surfaces of the exterior panel and the interior panel to define compartments between the exterior and interior panels; and at least one layer of metallic material fixed to at least one surface of the compartments.

9 Claims, 4 Drawing Sheets

THERMALLY REFLECTIVE PANEL ASSEMBLY

CROSS REFERENCE TO RELATED APPLICATIONS

This original non-provisional application claims the benefit of U.S. Provisional Application Ser. No. 61/461,958, filed Jan. 25, 2011 and entitled "Heat Reflector Roof Panel," which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to buildings. More specifically, the present invention relates to a panel assembly usable as residential load bearing roof decking that reflects solar thermal energy back into the atmosphere as well as reflecting internal thermal radiation back into the structure when retention of warm temperature is desired.

2. Description of the Related Art

Approximately eighty-five percent of heat energy entering a structure is due to solar radiation. Initially, absorption occurs at the Earth's atmosphere and then by striking the Earth. Objects on Earth then transfer the reduced heat energy through conduction or convection.

With respect to roof-top sheathing materials, the heated exterior surface of the roof conducts heat to interior surfaces. The rate of transfer, known as the R-factor, depends on the thickness and density of each individual material through which the radiation must pass.

In addition, interior chambers of a structure (e.g., an attic or living compartment) receive radiation from the inside surfaces of exterior material to inside air. This process sets up a convection cycle causing heat to transfer to the interior of the structure.

One approach to addressing the problem of heating from absorption is by lining the inner surface of the roof with a radiant barrier designed to reflect the energy. For example, Norbord Inc. of Canada manufactures a radiant barrier sheathing under the trade name SOLARBORD that is a combination of a heat-reflecting foil laminated to oriented strand board (OSB). Norbord reports that its radiant barrier sheathing reduces attic temperatures by up to thirty degrees (F.) and reduces radiant heat transfer through the roof by ninety-seven percent. See www.solarbordosb.com.

In addition to sheathing, properties of various materials and air may be combined to effectively reduce radiation transfer to the interior of a structure. Specifically, because still air, or "dead air," cannot directly conduct heat, convection must occur for heat transfer to take place. In other words, by reducing convection, heat transfer is also reduced. Radiation, however, passes through still air regardless of presence or absence of convection currents.

BRIEF SUMMARY OF THE INVENTION

The present invention represents an improvement to the art over typical radiant barrier sheathing, such as those described supra. By using the properties of still air, heat transfer is reduced, and these principles may be used in combination with, or as an alternative to, radiant barrier sheathing solutions.

The present invention comprises an exterior panel having opposing outer and inner surfaces separated by exterior panel edge surfaces; an interior panel having opposing outer and inner surfaces separated by interior panel edge surfaces that are aligned with the exterior panel edge surfaces; an intermediate section fixed to the inner surfaces of the exterior panel and the interior panel to define a plurality of compartments between the exterior and interior panels; and a layer of metallic material fixed to both inner and outer surfaces of the interior panel.

DETAILED DESCRIPTION OF THE INVENTION

Figure 1:
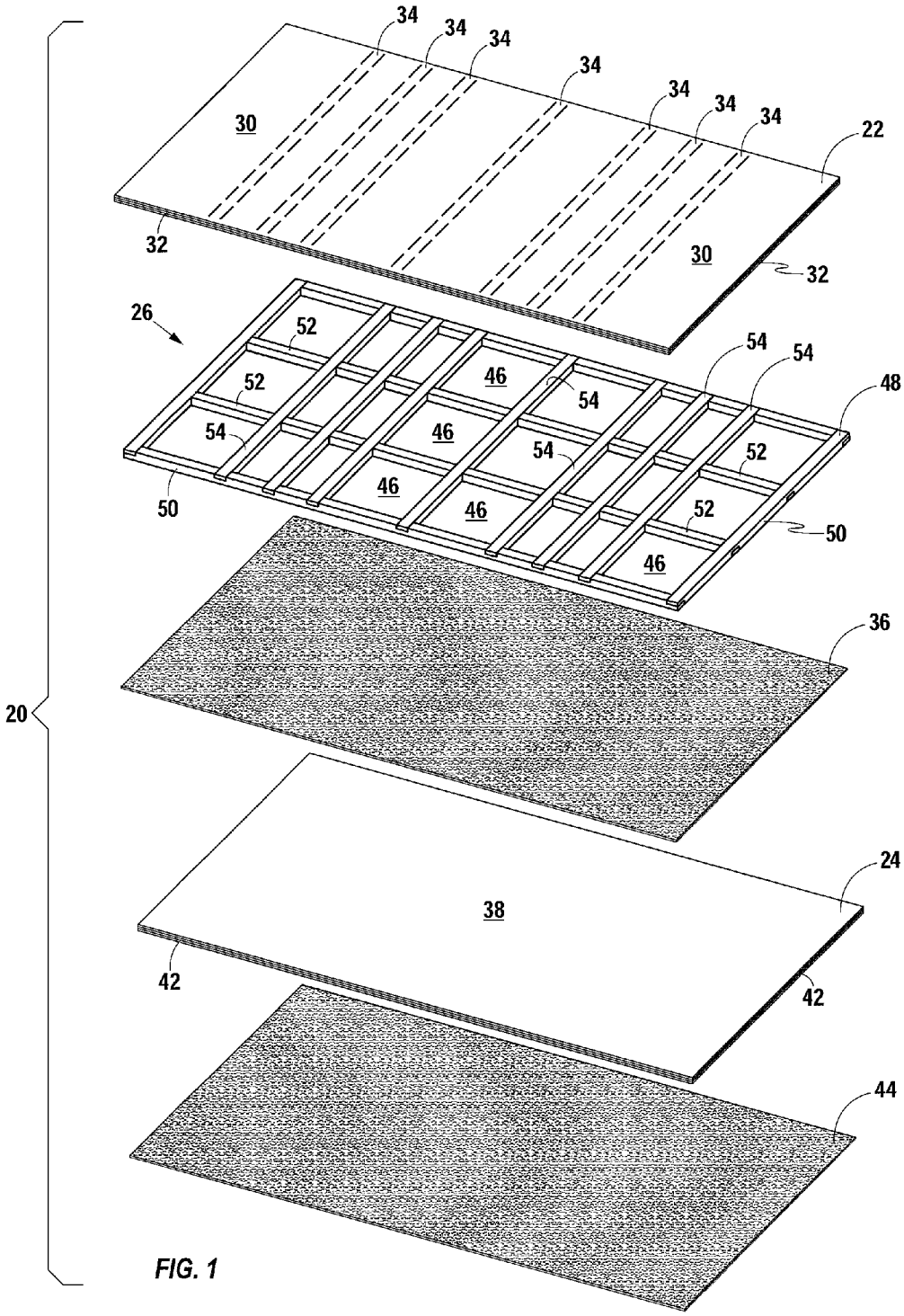
FIG. 1 is a top isometric assembly view of a preferred embodiment of the present invention.
Figure 2:
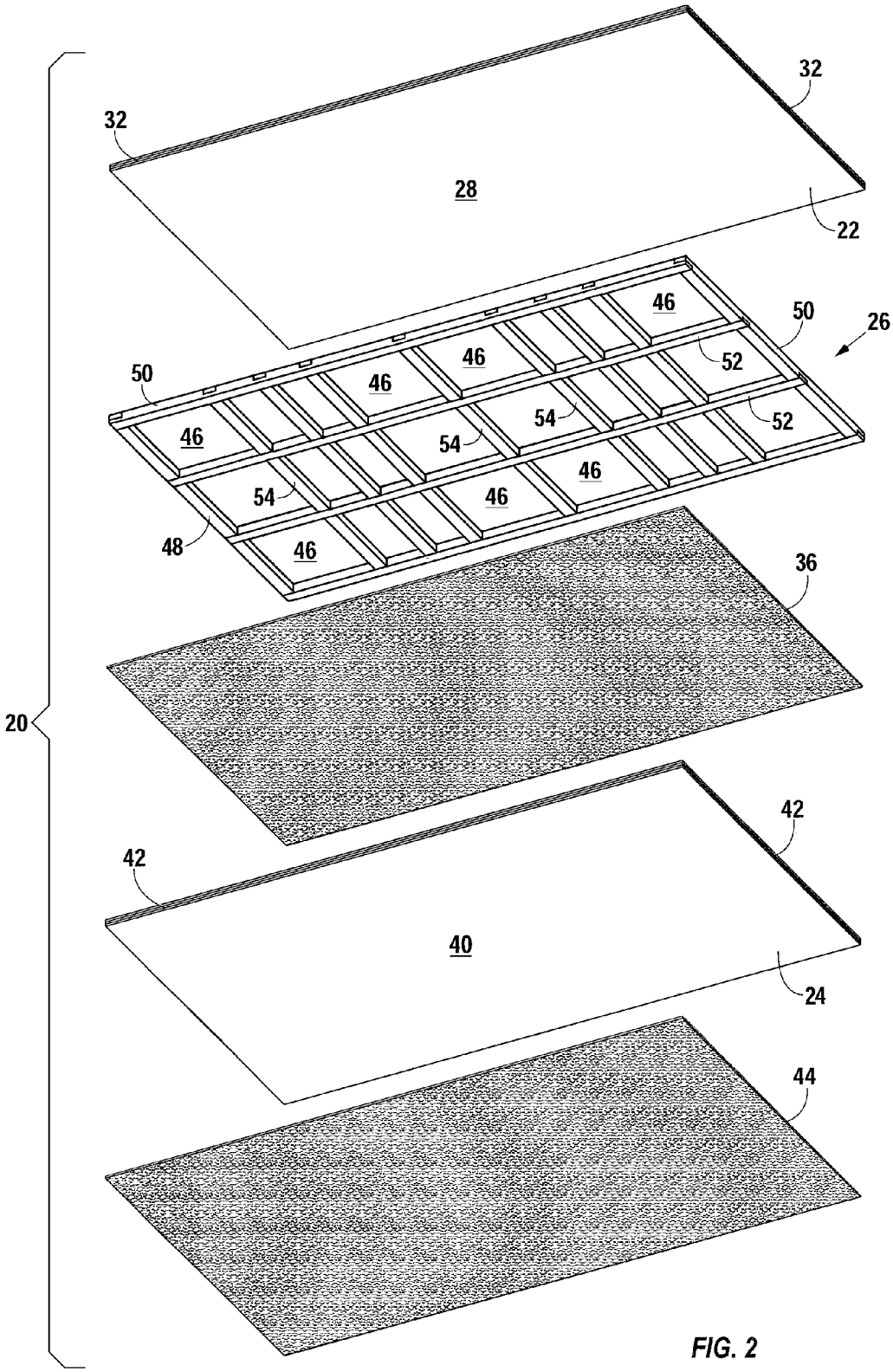
FIG. 2 is a bottom isometric assembly of the embodiment shown in FIG. 1.

FIGS. 1-2 are assembly views of the preferred embodiment of the present invention, which is a panel assembly 20 comprising an exterior panel 22, an interior panel 24, and an intermediate framework 26 made of wood or other insulative material. As used herein, exterior and interior refer to relative directions with respect to the house as the preferred embodiment is normally used. For example, in normal use, the exterior panel 22 is exterior of the interior panel 24 relative to the living space.

The panel assembly 20 is supported by roof rafters above the attic or living space, with outer surface 40 of interior panel 24 attached to top surfaces of the rafters. The exterior panel 22 has an inner surface 28 and an outer surface 30. The inner surface 28 and outer surface 30 are separated by exterior panel edge surfaces 32. The inner surface 28 and outer surface 30 are planar, and coplanar to one another. In the preferred embodiment, the exterior panel 22 is exterior grade plywood. The outer surface 30 has markings 34 corresponding to the relative positions of roof rafters to which it should be attached.

The interior panel 24 also has an inner surface 38 and an outer surface 40, which are separated by interior panel edge surfaces 42. The inner surface 38 and outer surface 40 are planar, and are coplanar to one another. In the preferred embodiment, the interior panel 24 is exterior grade plywood. A layer of aluminum foil 36 is bonded to the inner surface 38. Likewise, a layer of aluminum foil 44 is bonded to the outer surface 40.

The intermediate framework 26 is fixed to the inner surfaces 28, 38 of the exterior panel 22 and the interior panel 24, respectively, to define a plurality of closed compartments 46 between the exterior and interior panels 22, 24. The intermediate framework 26 has an outer frame 48 with frame edge surfaces 50. Longitudinal members 52 extend between a first set of opposing ends of the framework 26. Cross members 54 extend between a second set of opposing ends of the framework 26. The cross members 54 are aligned with the rafter markings 34 in the outer surface 30 of the exterior panel 22.

Figure 3:
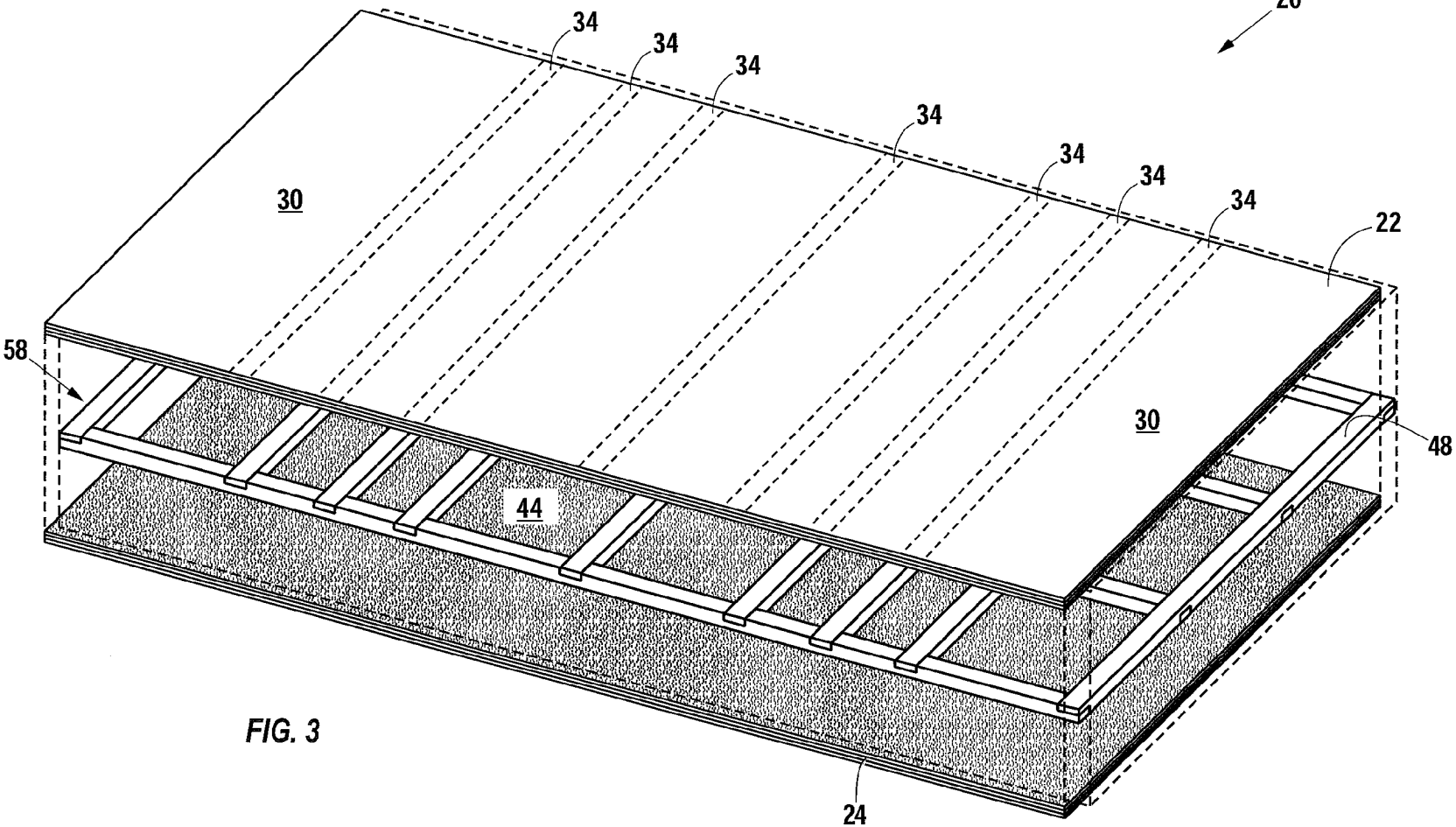
FIG. 3 is an assembly view of the embodiment depicted in FIGS. 1-2.
Figure 4:
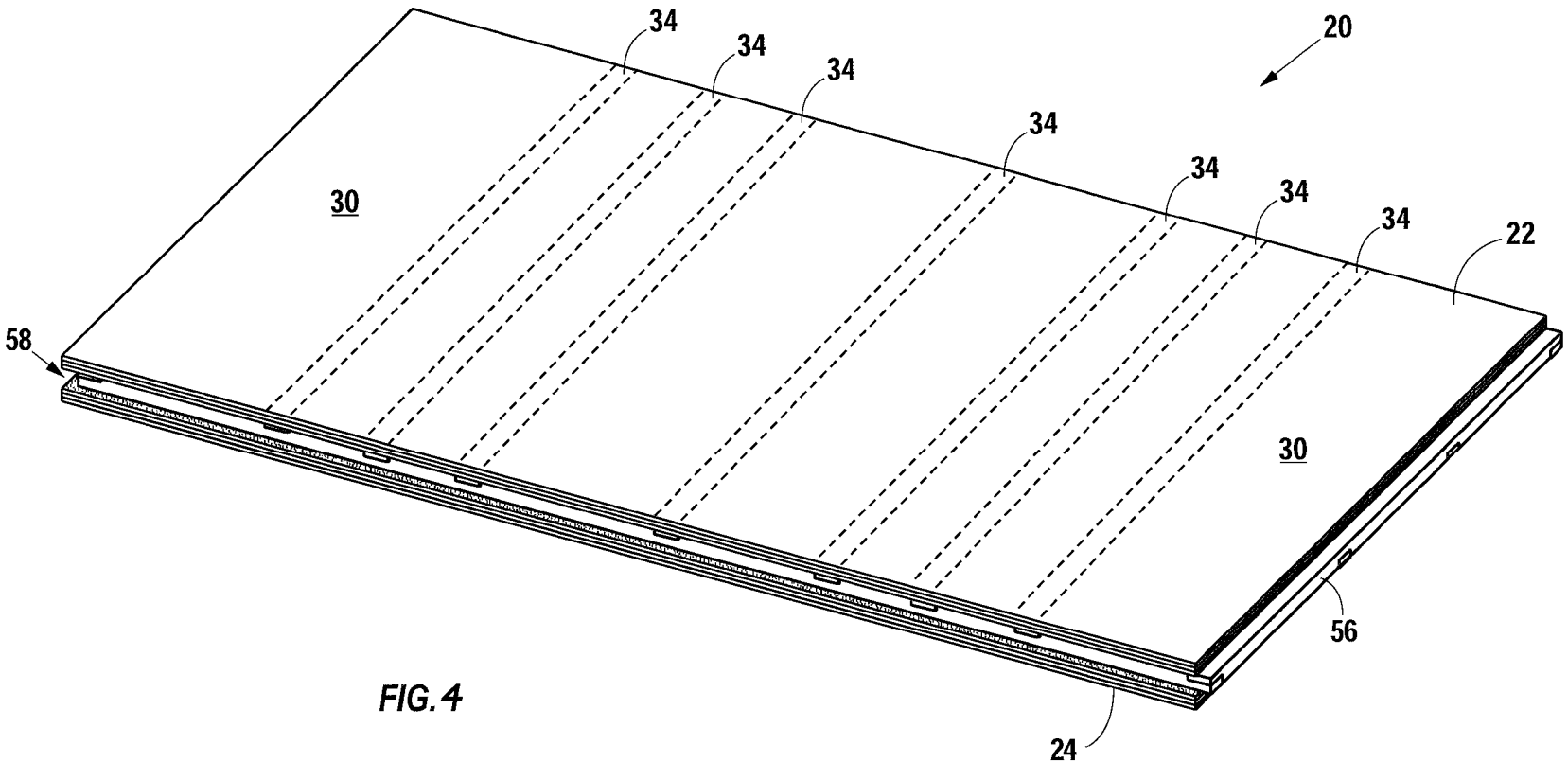
FIG. 4 is an isometric view of a fully assembled panel assembly shown in FIGS. 1-3.

As shown in FIGS. 3-4, when assembled, the frame edge surfaces 50 of the intermediate framework 26 are misaligned with the edge surfaces 32, 42 of the exterior and interior panels 22, 24 such that the intermediate framework 26 protrudes from at least one side of the panels 22, 24 to form a tongue protrusion 56. The misalignment forms a corresponding groove 58 on at least one opposing side of the panels 22, 24.

Installation and operation will be described with reference to a typical residential structure having an attic volume. The assembly 20 is fixed to the outside surface edges of the rafters using nails, screws, or other fasteners along the rafter markings in the outer surface of the exterior panel 22. The exterior panel 22 is positioned proximal to the interior surface of the roof. Multiple panel assemblies 20 may be interconnected by inserting a tongue 56 of one panel assembly into a corresponding groove 58 of an adjacent panel assembly. This tongue-and-groove interlock provides stability and tensile strength to the system of panel assemblies.

During a typical day, radiation enters the attic space through the exterior roofing material, through the exterior panel 22, and through the compartments 46 containing dead air. A large level of radiation is reflected by the layer of metallic foil 44 fixed to the inner surface 38 of the interior panel 24 back to the outside atmosphere. Similarly, during cold winter months, some of the radiation originating from within the residential structure reflects back into the interior volume of the residential structure due to reflection from metallic foil 44 fixed to the outer surface 40 of the interior panel 24. This results in less warming of the structure's volume during summer months and less heat loss from the structure to the environment during the colder winter months, with the use of panel assembly 20.

In a full-scale residential usage, a panel assembly 20 using a three-quarters inch deep sealed air compartment with dual opposite reflecting aluminum foil layers 36, 44 was added to a separate existing roof of one room. The roof of an adjoining room was used as a control. The existing roof of both rooms consisted of 2.25-inch wood fiber deck planking, 1.5-inch rigid mineral wool insulation board, and three-ply built up gravel. Both roofs were plank and beam construction without an attic space.

During twenty-four hour summer test periods, no cooling system was activated. The test room consistently achieved readings of fifteen to sixteen degrees below outdoor air temperature at peak daytime heating. The control room readings were nine to ten degrees (F.) under identical mutual exposure. The geographic locale where observations took place regularly reached outside afternoon air temperatures of ninety-five to one hundred degrees (F.).

In dropping internal room temperatures to approximately eighty-five degrees (F.) in the test room, it became apparent that the radiation reflection capability lowered room temperature by five degrees (F.) without air conditioned input. Therefore, the energy required to reduce internal temperature to eighty degrees with cooling system input was cut in half. In addition to R-factors of an existing roof deck, this embodiment of the invention added an R-factor of 4.42. Further field tests exposing a sample section of the panel in direct sunlight showed an average surface differential of one-hundred sixty five degrees (F.) at the sun side to eighty-five degrees (F.) at the shade side. Early morning temperatures comparing the control room with the test room showed heat retention from prior evening temperatures of four to six and a half degrees (F.).

The present invention is described above in terms of a preferred illustrative embodiment of a specifically-described roof panel. Those skilled in the art will recognize that alternative constructions of such an apparatus can be used in carrying out the present invention. Other aspects, features, and advantages of the present invention may be obtained from a study of this disclosure and the drawings, along with the appended claims.

I claim:

1. A thermally-reflective panel assembly for use in a structure, the panel assembly comprising:

an exterior panel having opposing outer and inner surfaces separated by exterior panel edge surfaces;

an interior panel having opposing outer and inner surfaces separated by interior panel edge surfaces that are aligned with the exterior panel edge surfaces, the outer surface having an outer surface area and the inner surface having an inner surface area;

an intermediate framework made from a thermally insulative material, said intermediate framework fixed to the inner surfaces of the exterior panel and the interior panel to define a plurality of closed compartments between the exterior an interior panels, said intermediate framework comprising: an outer flame having first and second sets of opposing ends and flame surface edges; a plurality of elongate first members extending between the first set of opposing ends, wherein each first member is spaced a distance from every other first member of said plurality of elongate first members and from the second set of opposing ends; a plurality of elongate second members extending between the second set of opposing ends and intersecting said plurality of elongate first members, wherein each second member is spaced a distance from every other second member of said plurality of elongate second members and from the first set of opposing ends; and wherein the pluralities of elongate members partially define the plurality of compartments; and wherein the frame edge surfaces are misaligned with the exterior panel edges and interior panel edges to define a tongue extending laterally from at least one side of the assembly and a corresponding groove in at least one opposing side of the assembly;

a first layer of metallic material fixed to the inner surface of the interior panel;

a second layer of metallic material fixed to the outer surface of the interior panel; and wherein the inner surface of the exterior panel and the inner surface of the interior panel partially define the plurality of closed compartments.

2. The panel assembly of claim 1 wherein the metallic material is aluminum foil.

3. The panel assembly of claim 1 wherein the surface area of the at least one first layer of metallic material is equal to the inner surface area.

4. The panel assembly of claim 1 wherein said insulative intermediate framework is made of wood.

5. A thermally-reflective panel assembly for use in a structure, the panel assembly comprising:

a first panel having opposing first and second surfaces separated by first panel edge surfaces;

a second panel having opposing first and second surfaces separated by second panel edge surfaces that are aligned with the exterior panel edge surfaces, the first surface having an first surface area and the second surface having an second surface area;

an intermediate framework made from a thermally insulative material, said intermediate framework fixed to the second surfaces of the first panel and the second panel to define a plurality of closed compartments between the first and the intermediate framework comprises: an outer frame having first and second sets of opposing ends and frame surface edges; a plurality of elongate first members extending between the first set of opposing ends, wherein each first member is spaced a distance from every other first member of said plurality of elongate first members and from the second set of opposing ends; a plurality of elongate second members extending between the second set of opposing ends and intersecting said plurality of elongate first members, wherein each second member is spaced a distance from every other second member of said plurality of elongate second members and from the first set of opposing ends; and wherein the pluralities of elongate members partially define the plurality of compartments and the frame edge surfaces are misaligned with the exterior panel edges and interior panel edges to define a tongue extending laterally from at least one side of the assembly and a corresponding groove in at least one opposing side of the assembly a first layer of metallic material fixed to the second surface of the second panel;

a second layer of metallic material fixed to the first surface of the second panel; and wherein the second surface of the first panel and the second surface of the second panel partially define the plurality of closed compartments.

6. The panel assembly of claim 5 wherein the metallic material is aluminum foil.

7. The panel assembly of claim 5 wherein the surface area of the at least one first layer of metallic material is equal to the inner surface area.

8. The panel assembly of claim 5 wherein said insulative intermediate framework is made of wood.

9. A thermally-reflective panel assembly for use in a structure, the panel assembly consisting of: a first panel having opposing first and second surfaces separated by first panel edge surfaces; a second panel having opposing first and second surfaces separated by exterior panel edge surfaces, the first surface having an first surface area and the second surface having a second surface area; an intermediate framework made from a thermally insulative material, said intermediate framework fixed to the second surfaces of the first panel and the second panel to define a plurality of closed compartments between the first and second panels; and a first layer of metallic material fixed to the second surface of the second panel; a second layer of metallic material fixed to the first surface of the second panel; and wherein the second surface of the first panel and the second surface of the second panel partially define the plurality of closed compartments.

* * * * *